United States Patent [19]

Ikeda et al.

[11] Patent Number: 5,051,069

[45] Date of Patent: Sep. 24, 1991

[54] MULTI-CYLINDER REFRIGERANT GAS COMPRESSOR WITH A MUFFLING ARRANGEMENT

[75] Inventors: Hayato Ikeda; Tetsuo Yoshida; Shinji Mizuno, all of Kariya, Japan

[73] Assignee: Kabushiki Kaisha Toyoda Jidoshokki Seisakusho, Aichi, Japan

[21] Appl. No.: 486,167

[22] Filed: Feb. 28, 1990

Related U.S. Application Data

[63] Continuation-in-part of Ser. No. 191,018, May 6, 1988, abandoned.

[30] Foreign Application Priority Data

May 13, 1987 [JP] Japan ..... 62-070173

[51] Int. Cl.[5] ..... F04B 1/12

[52] U.S. Cl. ..... 417/269; 181/403; 417/312

[58] Field of Search ..... 417/312, 313, 269; 181/403, 240

[56] References Cited

U.S. PATENT DOCUMENTS

| | | | |
|---|---|---|---|
| 4,407,638 | 10/1983 | Sasaya | 417/312 |
| 4,610,604 | 9/1986 | Iwamori | 417/269 |
| 4,863,356 | 9/1989 | Ikeda | 417/312 |
| 4,929,157 | 5/1990 | Steele | 417/312 |

FOREIGN PATENT DOCUMENTS

| | | | |
|---|---|---|---|
| 20780 | 2/1981 | Japan | 417/312 |

*Primary Examiner*—Richard A. Bertsch
*Assistant Examiner*—Peter Korytnyk
*Attorney, Agent, or Firm*—Burgess, Ryan & Wayne

[57] ABSTRACT

A multi-cylinder piston-operated compressor having a cylinder consisting of an axially combined cylinder block closed at both axial ends by front and rear housings having suction and discharge chambers therein, a reciprocative piston mechanism arranged in the cylinder for sucking, compressing, and discharging a refrigerant gas, and a connecting flange from which the refrigerant gas after compression is sent toward an air-conditioning circuit. The cylinder block and the connecting flange define a muffling chamber for deadening pulsation in the pressure of the discharged refrigerant gas. The compressor further has front and rear delivery passageways axially extending from the front and rear discharge chambers and having different axial lengths, to cause a pressure differential between the flow of the discharged refrigerant gas passing through the front delivery passageway and that of the discharged refrigerant gas passing through the rear delivery passageway, thereby producing an agitated flow of the compressed refrigerant gas within the muffling chamber.

5 Claims, 3 Drawing Sheets

MULTI-CYLINDER REFRIGERANT GAS COMPRESSOR WITH A MUFFLING ARRANGEMENT

CROSS-REFERENCE TO RELATED APPLICATION

This is a continuation-in-part application of copending U.S. Pat. application Ser. No. 191,018 filed on May 6, 1988, and now abandoned.

BACKGROUND OF THE INVENTION

1. Field of the Invention

The present invention relates to a multi-cylinder refrigerant gas compressor, preferably adapted for use in automobile air-conditioning system. More specifically, it relates to a swash plate type compressor with a mufflng arrangement for suppressing pulsations in the pressure of a refrigerant gas when discharged after compression.

2. Description of the Related Art

In a multi-cylinder refrigerant gas compressor for use in automobile air-conditioning system, refrigerant gas returning from the air-conditioning system is pumped into and compressed by a multi-cylinder compressing system having pistons operated by an actuator, such as a rotary swash plate. The compressed refrigerant gas is then discharged from the cylinder bores into discharge chambers provided axially at the front and/or rear of a cylinder unit of the compressor. The compressed refrigerant gas is divided and passed through separate discharge passageways of the cylinder block unit, and is then formed into a single mass. Subsequently, the mass of refrigerant gas is sent through a connecting flange element toward a cooling circuit of the air-conditioning system.

During the above-mentioned compression and discharge of the refrigerant gas, pulsation occurs in the pressure of the discharged gas, due to the reciprocating motion of the pistons. The frequency of the pulsation depends on the number of cylinder bores, and the pulsation must be suppressed to prevent noise and vibration. Accordingly, conventionally a muffling chamber is provided in the refrigerant-gas delivery circuit for reducing the pulsation in the pressure of the discharged refrigerant gas.

U.S. Pat. No. 4,610,604 to Iwamori discloses a multi-cylinder swash plate type compressor having a connecting flange which defines therein a muffling chamber and a collision zone. In the compressor, the refrigerant gas compressed by the swash-plate operated piston mechanism is delivered from front and rear discharge chambers as a pair of opposed streams of the compressed refrigerant gas into a collision zone wherein the opposed streams of refrigerant gas are allowed to directly collide, to thus weaken the pulsation in the pressure of the discharged compressed refrigerant gas. The refrigerant gas is then sent toward the muffling chamber, to ensure a complete suppression of the pulsation, and delivered to the cooling circuit via the connecting flange. Nevertheless, the compressor of U.S. Pat. No. 4,610,604 having the above-mentioned muffling and collision chambers is conventionally constructed in such a manner that the compression and discharge capacities exerted by the front chamber are substantially equal to those of the rear chamber of the compressor, and therefore, the opposed streams of the compressed gas are delivered from a pair of coaxially opposed orifices, arranged at two positions spaced equidistantly from the front and rear discharge chambers, into the collision zone, and thus the pulsation in the discharge pressure of the refrigerant gas is not sufficiently weakened. In this connection, if measures are taken to increase the volume of the muffling chamber to an extent such that the pulsation of the discharged refrigerant gas is satisfactorily muffled, the muffling chamber per se becomes very large, and accordingly, the size of the compressor as a whole is increased. As a result, for example, when the compressor is used as a compressing unit of a car airconditioning system, the compressor cannot be mounted in the engine compartment of a small car.

SUMMARY OF THE INVENTION

An object of the present invention is to obviate the above-mentioned defect of the muffling arrangement of the conventional multi-cylinder refrigerant compressor.

Another object of the present invention is to provide a multi-cylinder swash plate type compressor having a muffling arrangement capable of enhancing the suppression of the pulsation in the pressure of the discharged compressed refrigerant gas, without increasing the volume of the muffling chamber.

A further object of the present invention is to provide a multi-cylinder swash plate type compressor in which a quiet operation is maintained.

In accordance with the present invention, there is provided a multi-cylinder swash plate type compressor adapted for compressing a refrigerant gas of a cooling circuit, which includes:

a cylinder block unit comprising a front and a rear cylinder block of an unequal axial length having therein a swash-plate operated reciprocative piston mechanism for sucking, compressing, and discharging a refrigerant gas:

housings arranged so as to close axial front and rear ends of the cylinder block unit and having therein front and rear suction chambers for the refrigerant gas before compression and front and rear discharge chambers for the refrigerant gas after compression, the front and rear suction and discharge chambers being in communication with the reciprocative piston mechanism of the cylinder block unit;

front and rear delivery passage means arranged in the cylinder block unit for delivering first and second flows of the refrigerant gas in alignment with each other but in opposite directions, after compression from the front and rear discharge chambers of the housings, respectively;

walls extending from the cylinder block unit, for defining therein a muffling chamber for deadening pulsation in the pressure of the first and second flows of the refrigerant gas delivered after compression from the front and rear delivery passage means of the cylinder block unit;

a connecting flange unit mounted on said walls, for closing the muffling chamber and sending the compressed refrigerant gas from the muffling chamber to the cooling circuit, a first communicating means for permitting the first flow of the refrigerant gas after compression to enter the muffling chamber from the front delivery passage means;

a second communicating means for permitting the second flow of the refrigerant gas after compression to enter the muffling chamber from the rear delivery passage means; and a means for causing a differential of pressure between the first and second flows of the compressed refrigerant gas before the first and second flows of the refrigerant gas enter the muffling chamber, to thereby deaden any pulsation in the pressure of the refrigerant gas within the muffling chamber.

BRIEF DESCRIPTION OF THE DRAWING

The present invention will be more apparent from the ensuing description of the embodiment thereof with reference to the accompanying drawing, wherein.

DESCRIPTION OF THE PREFERRED EMBODIMENT

Figure 1:
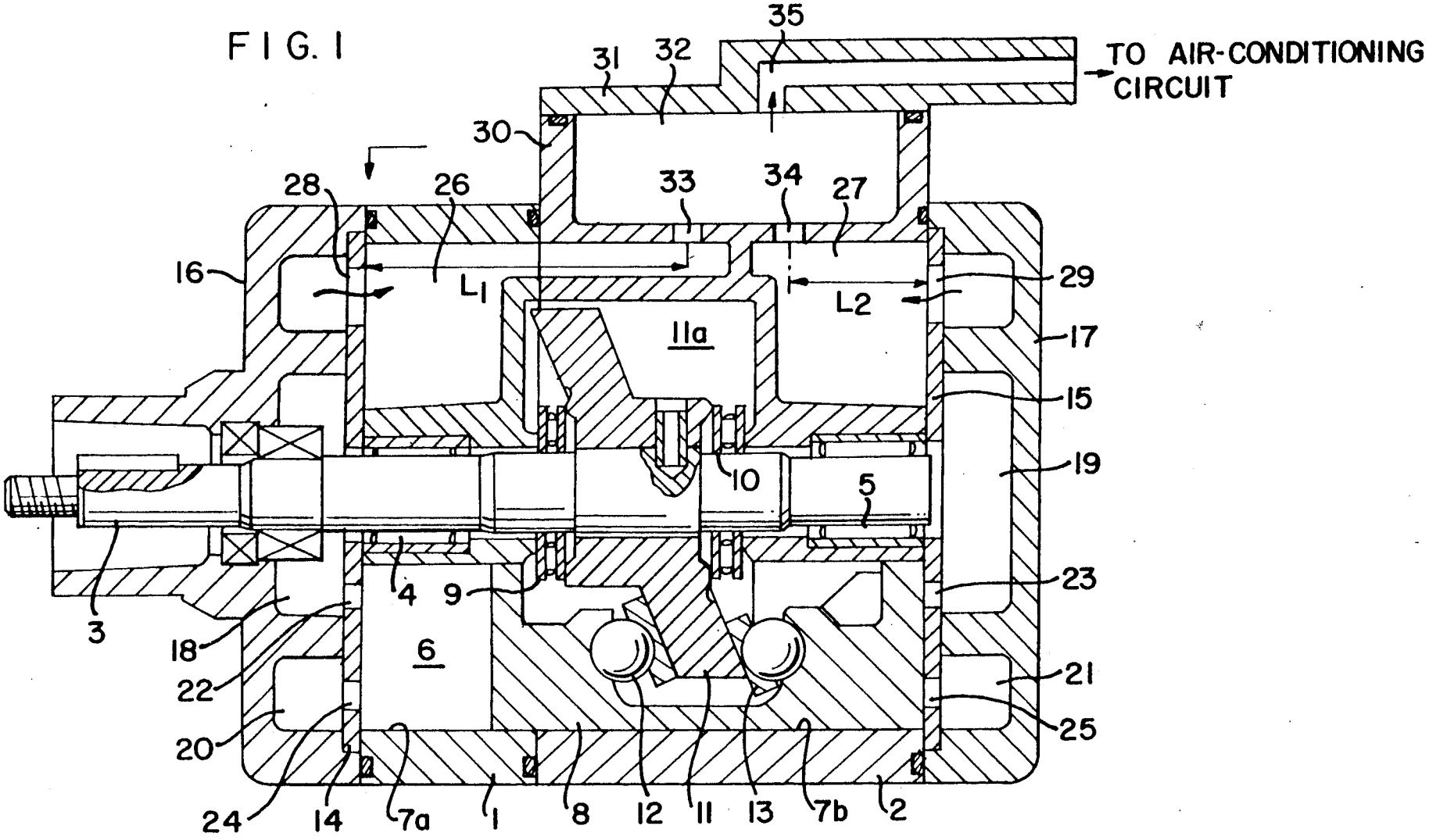
FIG. 1 is a longitudinal cross-sectional view of a multi-cylinder swash plate type compressor according to an embodiment of the present invention.

Referring to FIG. 1, the multi-cylinder swash plate type compressor comprises a round cylinder having front and rear cylinder blocks 1 and 2 sealingly combined therewith in axial alignment. The plane of the junction of the two cylinder blocks 1 and 2 is offset from the center of the combined cylinder toward the front cylinder block 1. Namely, the rear cylinder block 2 is axially longer than the front cylinder block 1. The compressor is also provided with an axial drive shaft 3 centrally and rotatably supported in the cylinder by radial bearings 4 and 5. A swash plate 11 is fixed the drive shaft 3 and is rotated within a swash plate chamber 11*a* arranged in the central portion of the cylinder. The cylinder is formed with an appropriate number of axial cylinder bores 6, each having axially aligned cylinder bores 7*a* and 7*b* formed in the cylinder blocks 1 and 2. The cylinder bores 6 of the cylinder are arranged in parallel with one another and with the above-mentioned drive shaft 3, and within the cylinder bores 6 are disposed a number of double-headed pistons 8 reciprocated by the rotation of the swash plate 11 via ball bearings 12 and shoes 13. The swash plate 11 rotating together with the drive shaft 3 is axially supported by thrust bearings 9 and 10.

The front and rear ends of the cylinder are fluid-tightly closed by front and rear housings 16 and 17, respectively, via front and rear valve plates 14 and 15. The front and rear housings 16 and 17 have inner suction chambers 18 and 19 and outer annular discharge chambers 20 and 21, respectively, formed therein. The suction chambers 18 and 19 of the front and rear housings 16 and 17 are respectively communicated with the cylinder bores 6 via suction ports 22 and 23 bored in the front and rear valve plates 14 and 15, and the discharge chambers 20 and 21 of the front and rear housings 16 and 17 are respectively communicated with the cylinder bores 6 via discharge ports 24 and 25 bored in the front and rear valve plates 14 and 15. The suction ports 22 and 23 and the discharge ports 24 and 25 are opened and closed by conventional reed valves (not illustrated in FIG. 1). The cylinder consisting of the combined cylinder blocks 1 and 2 has discharge passageways 26 and 27 formed therein which are communicated with the discharge chambers 20 and 21 of the front and rear housings 16 and 17 via communicating bores 28 and 29 formed in the front and rear valve plates 13 and 14. The discharge passageway 26 is arranged in the front and rear cylinder blocks 1 and 2 in the form of a radially and axially extending cavity circumferentially disposed between two preselected neighbouring cylinder bores 6. The discharge passageway 27 is arranged in the rear cylinder block 2 in the form of a radially and axially extending cavity circumferentially disposed between the same two neighbouring cylinder bores 6. Accordingly, the compressed refrigerant gas is discharged from the discharge chambers 20 and 21 toward an outer air-conditioning circuit through these discharge passageways 26 and 27 and a muffling arrangement described hereinafter.

The muffling arrangement comprises two axially spaced walls 30 projected radially outward from the outer circumference of one of the combined cylinder blocks 1 and 2, i.e., the longer rear cylinder block 2 in the case of the present embodiment, to enclose an open chamber having a substantial volume. The walls 30 are formed integrally with the rear cylinder block 2. Sealingly mounted on the top of the walls 30 is a connecting flange 31, which closes the open chamber of the walls 30 to define a closed muffling chamber 32. The connecting flange 31 is provided with an orifice 35 through which the compressed refrigerant gas, the pulsation of which has been weakened in the muffling chamber 32, is sent toward the outer air-conditioning circuit.

The muffling chamber 32 is in fluid communication with the front delivery passageway 26 via an orifice 33 and with the rear delivery passageway 27 via an orifice 34, respectively. The orifices 33 and 34 are formed in the outer wall of the rear cylinder block 2.

The orifice 33 is spaced at an axial distance $L_1$ from the bore 28 of the front valve plate 14, and the orifice 34 is spaced at an axial distance $L_2$ from the bore 29 of the rear valve plate 15. Namely, the axial length of the front delivery passageway 26 is $L_1$, and that of the rear delivery passageway 27 is $L_2$. Note, the axial length $L_1$ of the front delivery passageway 26 is intentionally made longer than the axial length $L_2$ of the rear delivery passageway 27.

In the swash plate type compressor having the above-described structure, the operations of the compressor, i.e., suction, compression, and discharge of the refrigerant gas, are conducted by the rotation of the drive shaft 3. The drive shaft 3 is rotated from the outside, for example, by an automobile engine system. The rotation of the drive shaft 3 together with the swash plate 11 causes a reciprocative motion of the pistons 8 in the cylinder bores 6, and thus the refrigerant gas returning from the air-conditioning circuit is drawn into the cylinder bores 6 via the suction port, the front and rear suction chambers 18 and 19, and the front and rear suction ports 22 and 23. The refrigerant gas is then compressed by the reciprocating pistons 8.

The compressed refrigerant gas under a high pressure, which is the cause of pressure pulsation, is discharged from the cylinder bores 6 to the discharge chambers 20 and 21 through the discharge ports 24 and 25 of the front and rear valve plates 14 and 15. The refrigerant gas in both discharge chambers 20 and 21 is then sent through the delivery passageways 26 and 27 and through the orifices 33 and 34 toward the muffling chamber 32, in which the pulsation of the pressure of the refrigerant gas is deadened. The opeartion of deadening the pulsation of the pressure of the refrigerant gas is described below.

In accordance with the above-mentioned arrangement of the front and rear delivery passageways 26 and 27, the compressed refrigerant gas discharged from the communicating bore 28 of the front discharge chamber 20 must flow over a longer distance $L_1$ before entering the muffling chamber 32 via the orifice 33, in comparison with the compressed refrigerant gas discharged from the communicating bore 29 of the rear discharge chamber 21 flowing over the distance $L_2$ before entering the muffling chamber 32 via the rear orifice 34. Therefore, a pressure drop occurs in the former flow of the compressed refrigerant gas passing through the front delivery passageway 26, due to a flow resistance which is larger than that encountered by the latter rear flow of the compressed refrigerant gas passing through the rear delivery passageway 27. Accordingly, pulsation in the pressure of the former flow of the compressed refrigerant gas is reduced to a level lower than that of pulsation in the pressure of the latter flow of the compressed refrigerant gas. As a result, when the flows of the compressed refrigerant gas from the front and rear discharge chambers 20 and 21 enter the muffling chamber 32, the pressure level and the pulsation level of the former flow of the compressed refrigerant gas are lower than those of the latter flow of the compressed refrigerant gas. Consequently, agitation occurs in the flow of the compressed refrigerant gas in the muffling chamber 32, due to the difference in the flow strength between the former and latter flows of the refrigerant gas. Accordingly, the agitated flow of refrigerant gas collides with the wall of the muffling chamber 32, to lose the energy held therein, and thus the pulsation in the agitated flow of the compressed refrigerant gas is gradually deadened. Also, a collision of the former and latter flows occurs within the muffling chamber 32, to further deaden the pulsation in the pressure of the compressed refrigerant gas in the muffling chamber 32. The results of experiments by the inventors confirmed that the deadening of the pulsation in the pressure of the compressed refrigerant gas by the above-described muffling arrangement is 30% more effective than by the conventional muffling arrangement.

Figure 2:
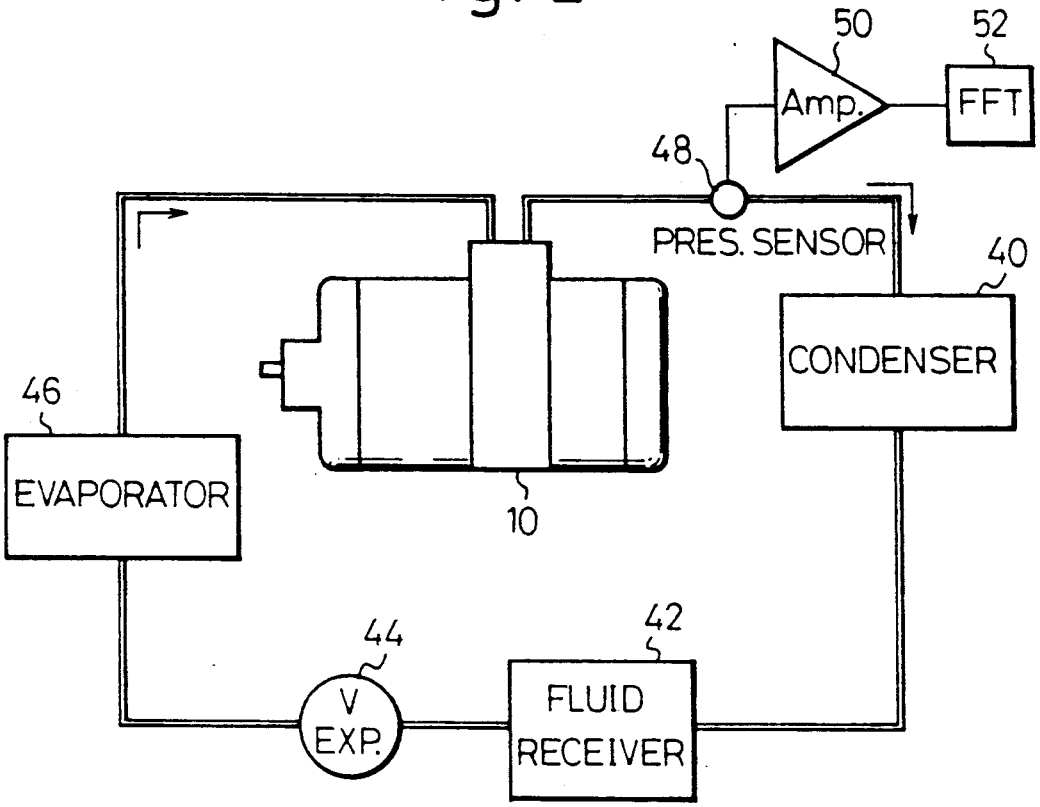
FIG. 2 is a block diagram of a refrigerating system including a sample compressor used for conducting an experiment to confirm the advantages of the present invention.

To confirm the advantageous effect of the present invention, the inventors conducted an experiment by using a test system as shown in FIG. 2. Namely, a sample compressor 10 including five front cylinder bores, five rear cylinder bores, an internal muffling chamber, and front and rear delivery passages of different lengths, was accommodated in the refrigerating system including a condensor 40, a refrigerant fluid receiver 42, an expansion valve 44, and an evaporator 46. Further, a pressure sensor 48 for detecting a change in a pressure of the discharged refrigerant gas was attached to a refrigerant conduit connecting between the outlet port of the sample compressor 10 and the condensor 40, and the result of the detection of the pressure detector 48 was supplied to the Fast Fourier Analyzer ( FFT ) 52, via an amplifier 50, to analyze the pulsation in the pressure of the discharged refrigerant gas. When conducting the experiment, the test compressor 10 was rotated at 1,000 r.p.m, which is a rather low but typical running speed of a car compressor, and a detection of the pressure was conducted after a constant pressure condition was obtained.

Figure 3:
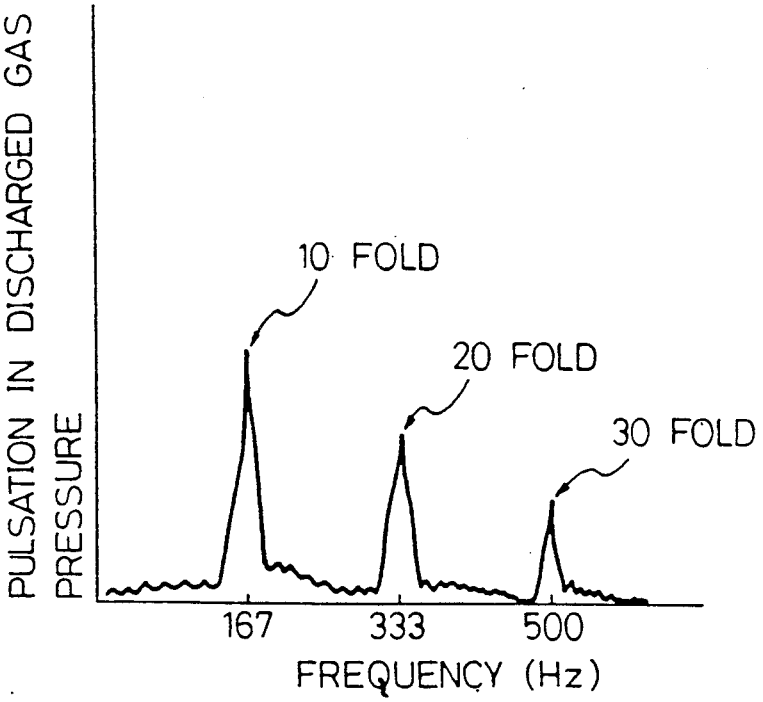
FIG. 3 is a graph illustrating the result of the experimnet.
Figure 4:
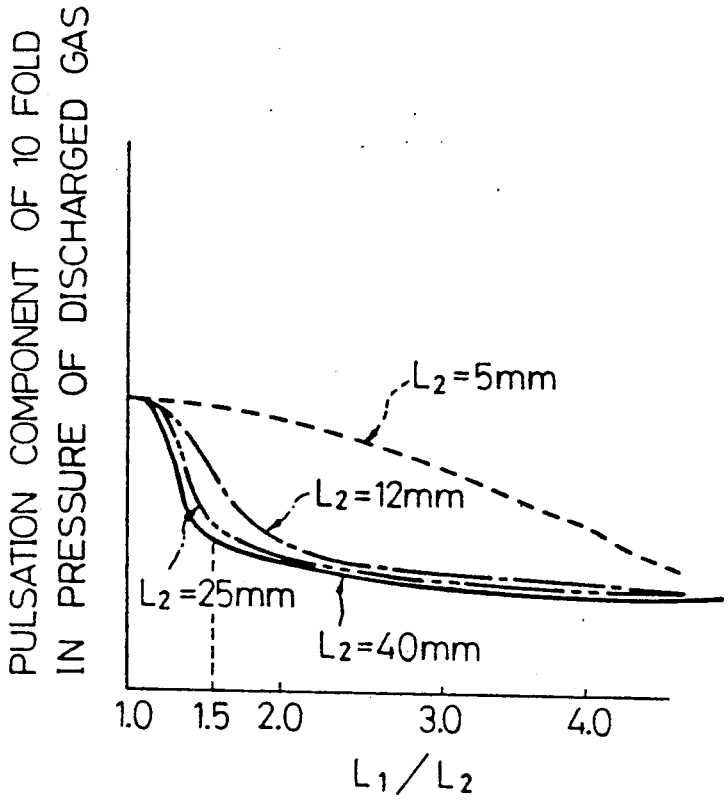
FIG. 4 is another graph illustrating the advantages obtained by the present invention.

FIG. 3 indicates the result of the frequency analyzing of the pulsation in the pressure of the discharged refrigerant gas from the sample compressor 10 having ten cylinder bores (five front and five rear cylinder bores as shown in FIG. 1). The abscissa indicates the number of frequencies in the pulsation of the discharged gas pressure, and the ordinate indicates the discharged gas pressure exhibiting a pulsation. From FIG. 3, it was confirmed that, in the ten cylinder bore type compressor, the pressure peaks appear at specific frequencies, i.e., 167 Hz, 333 Hz, and 500 Hz corresponding to 10, 20 and 30 fold of the rotating speed (1,000 r.p.m=approximately 16.7 revolution per second), and the maximum peak pressure appears at a frequency 10 fold of the rotating speed of the compressor. Therefore, the inventor also conducted a measurement of a change in the pressure value of the discharged refrigerant gas at the frequency 10 fold of the rotating speed of the compressor while changing the ratio $L_1/L_2$ of lengths of the first and second communication passages. As a result, as shown in the curves of FIG. 4, it was found that, when $L_2$ was from 5 mm to 40 mm with respect to the range of 1 through approximately less than 4 of $L_1/L_2$, the pulsation in the discharged refrigerant gas pressure was reduced under a condition such that $L_2$ is larger than 10 mm, and $L_1/L_2$ is equal to or larger than 1.5.

From the foregoing description of the embodiment of the present invention, it will be understood that, according to the present invention, there is provided a multi-cylinder refrigerant gas compressor with a muffling arrangement in which pulsation of the pressure of the refrigerant gas after compression is deadened by agitating the flow of the refrigerant gas and allowing the flows of the refrigerant gas per se to collide. This provides an appreciable reduction in the noise level and vibration of the muti-cylinder refrigerant gas compressor.

It should be understood that modifications and variations of the present invention will occur to those skilled in the art of the spirit and scope of the appended claims.

We claim:

1. A multi-cylinder swash plate type compressor adapted for use in compressing a refrigerant gas of a cooling circuit comprising:

cylinder block means comprising a front and a rear cylinder block of an unequal axial length having therein a swash-plate operated reciprocative piston mechanism having five front cylinder bores and five rear cylinder bores in alignment with said front cylinder bores, for sucking, compressing and discharging a refrigerant gas;

housing means arranged so as to close axial front and rear ends of the cylinder block means and having therein front and rear suction chambers for the refrigerant gas before compression and front and rear discharge members for the refrigerant gas after compression, said front and rear suction and discharge chambers being in communication with the reciprocative piston mechanism of the cylinder block means;

front and rear delivery passage means arranged in said cylinder block means for delivering first and second flows of the refrigerant in alignment with each other but in opposite directions, after compression from said front and rear discharge chambers of said housing means, respectively;

wall means extending from said cylinder block means, for defining therein a muffling chamber for deadening pulsation in the pressure of the first and second flows of the refrigerant gas after compression delivered from said front and rear delivery passage means of said cylinder block means;

connecting flange means mounted on said wall means for closing said muffling chamber and sending the compressed refrigerant gas from said muffling chamber to the cooling circuit;

first communicating means for permitting the first flow of the refrigerant gas after compression to enter the muffling chamber from said front delivery passage means;

second communicating means for permitting the second flow of the refrigerant gas after compression to enter the muffling chamber from rear delivery passage means; and means for causing a differential of pressure between the first and second flows of the compressed refrigerant gas before said first and second flows of the refrigerant gas into said muffling chamber, comprising an arrangement wherein said front delivery passage means has a first refrigerant passage length $L_1$ axially extending between said front discharge chamber and said first communicating means, and said rear delivery passage means has a second refrigerant passage length $L_2$ axially extending between said rear discharge chamber and said communicating means, said first refrigerant passage length $L_1$ and said second refrigerant passage length $L_2$ being selected on condition that $L_1/L_2$ is equal to or larger than 1.5, to thereby further deaden pulsation in the pressure of the refrigerant gas in said muffling chamber.

2. A multi-cylinder swash plate type compressor according to claim 1, wherein said swash-plate operated reciprocative piston mechanism of said cylinder block means has five front cylinder bores and five rear cylinder bores in alignment with said front cylinder bores, and wherein said means for causing a differential of pressure between the first and second flows of the compressed refrigerant gas comprises an arrangement wherein said front delivery passage means has a first refrigerant passage length "$L_1$" axially extending between said front discharge chamber and said first communicating means, and said rear delivery passage means has a second refrigerant passage length "$L_2$" axially extending between said rear discharge chamber and said second communicating means, said first refrigerant passage length "$L_1$" and said second refrigerant passage length "$L_2$" being selected on condition that $L_1/L_2$ is equal to or larger than 1.5.

3. A multi-cylinder swash plate type compressor according to claim 1, wherein said wall means for defining therein a muffling chamber for deadening in the pulsation pressure of the refrigerant gas is integral with said cylinder block means.

4. A multi-cylinder swash plate type compressor according to claim 1, wherein said first communicating means for permitting the first flow of the refrigerant gas after compression to enter the muffling chamber from said front delivery passage means comprises a first orifice formed in said cylinder block so as to open toward said muffling chamber, and wherein said second communicating means for permitting the second flow of the refrigerant gas after compression to enter the muffling chamber from said rear delivery passage means also comprises a second orifice formed in said cylinder block means and opening toward said muffling chamber.

5. A multi-cylinder swash plate type compressor according to claim 4, wherein said means for causing a differential of pressure between the first and second flows of the compressed refrigerant gas comprises an arrangement wherein said front delivery passage means has a first refrigerant passage length axially extending between a discharge bore of said front discharge chamber and said first orifice, and said rear delivery passage means has a second refrigerant passage length axially extending between a discharge bore of said rear discharge chamber and said second orifice.

* * * * *